US007495651B2

(12) United States Patent
Zhou et al.

(10) Patent No.: US 7,495,651 B2
(45) **Date of Patent: *Feb. 24, 2009**

(54) ELECTROPHORETIC DISPLAY PANEL

(75) Inventors: Guofu Zhou, Eindhoven (NL); Mark Thomas Johnson, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 547 days.

This patent is subject to a terminal disclaimer.

(21) Appl. No.: 10/547,590

(22) PCT Filed: Feb. 26, 2004

(86) PCT No.: PCT/IB2004/050155

§ 371 (c)(1),
(2), (4) Date: Sep. 1, 2005

(87) PCT Pub. No.: WO2004/079705

PCT Pub. Date: Sep. 16, 2004

(65) Prior Publication Data

US 2006/0187186 A1 Aug. 24, 2006

(30) Foreign Application Priority Data

Mar. 7, 2003 (EP) ..... 03100575

(51) Int. Cl.
*G09G 3/34* (2006.01)

(52) U.S. Cl. ..... 345/107; 345/86; 359/296

(58) Field of Classification Search ..... 345/86, 345/107; 359/296

See application file for complete search history.

(56) References Cited

U.S. PATENT DOCUMENTS

| | | | | |
|---|---|---|---|---|
| 5,961,804 | A | 10/1999 | Jacobson et al. | |
| 6,120,839 | A | 9/2000 | Comiskey et al. | |
| 6,130,774 | A | 10/2000 | Albert et al. | |
| 6,504,524 | B1 | 1/2003 | Gates et al. | |
| 2002/0005832 | A1 | 1/2002 | Katase | |
| 2002/0021483 | A1 | 2/2002 | Katase | |
| 2002/0196207 | A1 | 12/2002 | Machida et al. | |
| 2007/0262949 | A1 * | 11/2007 | Zhou et al. | 345/107 |

* cited by examiner

*Primary Examiner*—Richard Hjerpe
*Assistant Examiner*—Kimnhung Nguyen
(74) *Attorney, Agent, or Firm*—Michael E. Belk

(57) ABSTRACT

The electrophoretic display panel (1) for displaying pictures has drive means (100) which are arranged for controlling the potential difference of each picture element (2) to be a picture potential difference having a picture value and an associated picture duration representing a picture energy for enabling the particles (6) to occupy one of the positions for displaying one of the pictures, subsequently to be an inter-picture potential difference having an inter-picture value and an associated inter-picture duration representing an inter-picture energy and subsequently to be a subsequent picture potential difference for enabling the particles (6) to occupy one of the positions for displaying a subsequent one of the pictures. For the display panel (1) to be able to subsequently display pictures of at least relatively medium quality and to have a reduced visibility of the inter-picture appearances of the picture elements (2), the drive means (100) are arranged for controlling for each picture element (2) the inter-picture value to have a sign opposite to a sign of the picture value, the inter-picture energy to be insufficient to substantially change the position of the particles (6) and chosen in a range from larger than zero to substantially equal to the picture energy for reducing an undesired charge accumulation in the picture element (2).

8 Claims, 4 Drawing Sheets

ELECTROPHORETIC DISPLAY PANEL

The invention relates to an electrophoretic display panel for displaying pictures, comprising:

an electrophoretic medium comprising charged particles in a fluid;

a plurality of picture elements;

a first and a second electrode associated with each picture element for receiving a potential difference; and drive means, the charged particles being able to occupy a position being one of a number of positions between the electrodes, and the drive means being arranged for controlling the potential difference of each picture element to be a picture potential difference having a picture value and an associated picture duration representing a picture energy for enabling the particles to occupy one of the positions for displaying one of the pictures, subsequently to be an inter-picture potential difference having an inter-picture value and an associated inter-picture duration representing an inter-picture energy and subsequently to be a subsequent picture potential difference for enabling the particles to occupy one of the positions for displaying a subsequent one of the pictures.

In electrophoretic display panels in general, the picture elements have, during the display of each picture, appearances determined by the positions of the charged particles between the electrodes. Furthermore, insulating layers are present between the electrodes, which become charged as a result of the potential differences. The charge present at the insulating layers is determined by the charge initially present at the insulating layers and the subsequent history of the potential differences. Therefore, the positions of the particles depend not only on the potential differences, but also on the history of the potential differences. As a result the pictures subsequently being displayed according to image information differ significantly from the pictures being an exact representation of the image information. Therefore, the display panel is able to subsequently display pictures of only relatively low quality. In a known method to reduce the dependency on the history due to the charging of the insulators the inter-picture potential difference of each picture element is a reset potential difference. For each picture element, the picture potential difference and the reset potential difference have equal polarities and the reset potential difference enables particles to substantially occupy one of the two extreme positions near the electrodes. In the subsequent picture update the particles substantially occupy the other one of the two extreme positions. As the total energy represented by the picture potential difference and the reset potential difference is substantially equal to the total energy represented by the subsequent picture potential difference and the subsequent reset potential difference, the charge present at the insulating layers prior to the application of the picture potential difference is substantially equal to the charge present at the insulating layers prior to the application of the picture potential difference after two picture updates. Therefore, the dependency on the history due to the charging of the insulators is reduced and the display panel is able to subsequently display pictures of relatively high quality. As a result of the reset potential differences the picture elements have substantially equal inter-picture appearances, e.g. white or black, between displaying subsequent pictures. Unfortunately, the picture elements having the inter-picture appearances are well visible for an observer, if, as is generally the case, a substantial number of the picture elements have appearances in subsequent pictures, which are unrelated. The picture elements having the inter-picture appearances are less visible if the picture elements have the inter-picture appearances during a reduced time interval. This can be realized by increasing the reset potential differences. However, it is undesirable to increase the reset potential differences as the display panel is intended to operate at relatively low potential differences of for instance 15 Volts.

It is a drawback of the known display panel that the picture elements having the inter-picture appearances are in general relatively much visible.

It is an object of the invention to provide a display panel of the kind mentioned in the opening paragraph which is able to subsequently display pictures of at least relatively medium quality and to have a reduced visibility of the inter-picture appearances of the picture elements.

The object is thereby achieved that the drive means are arranged for controlling for each picture element the inter-picture value to have a sign opposite to a sign of the picture value and the inter-picture energy to be insufficient to substantially change the position of the particles and chosen in a range from larger than zero to substantially equal to the picture energy for reducing an undesired charge accumulation in the picture element.

As a result of the inter-picture value having a sign opposite to the sign of the picture value and the inter-picture energy chosen in a range from larger than zero to substantially equal to the picture energy for reducing an undesired charge accumulation in the picture element, at least part of the charging of the insulators due to the picture potential difference is undone. Therefore, the display panel is able to subsequently display pictures of at least relatively medium quality. The inter-picture energy is insufficient to substantially change the position of the particles, one cause might be that the viscous force between the particles and the fluid is able to substantially counteract the electric force on the particles as a result of the application of the inter-picture potential difference. Therefore, the application of the inter-picture potential differences has substantially no effect on the appearances of the picture elements and the inter-picture appearances of the picture elements are substantially equal to the appearances for displaying the picture. As a result, the observer perceives a relatively smooth transition from the picture via a picture being substantially equal to the picture to the subsequent picture. As a result, the display panel is able to have a reduced visibility of the inter-picture appearances of the picture elements.

The inter-picture energy of each picture element may be controlled by controlling both the inter-picture value and the inter-picture duration.

If the drive means are arranged for controlling for each picture element the inter-picture value to have a magnitude substantially equal to a magnitude of the picture value, relatively simple drive electronics may be used having only relatively few different values of the potential differences, e.g. three different values, e.g. −15 Volts, 0, 15 Volts.

If the drive means are arranged for controlling for each picture element the inter-picture value to have a magnitude being at least one order of magnitude smaller than a magnitude of the picture value, the inter-picture value is relatively low. Preferably, the drive means are arranged for controlling for each picture element the inter-picture value to have a magnitude being two orders of magnitude smaller than the magnitude of the picture value.

If the drive means are arranged for controlling for each picture element the inter-picture potential difference to have a predetermined number of sub-inter-picture potential differences, each sub-inter-picture potential difference having a sub-inter-picture value and an associated sub-inter-picture duration representing a sub-inter-picture energy, a time average of the inter-picture values having a sign opposite to the sign of the picture value, and each sub-inter-picture energy being insufficient to substantially change the position of the particles, each inter-picture potential difference comprises more than one sub-inter picture potential difference. The number of sub-inter picture potential differences can be chosen. Therefore, it is possible to undo at least a relatively large part of the charging of the insulators due to each picture potential difference. If, furthermore, the drive means are arranged for controlling for each picture element each inter-picture value to have a sign opposite to the sign of the picture value, each sub-inter picture potential difference has the effect of at least partly undoing the charging of the insulators due to the picture potential difference. If, furthermore, the inter-picture energy is substantially equal to the picture energy, the charging of the insulators due to each picture potential difference is substantially undone and the display panel is DC balanced after each picture update. The display panel is able to subsequently display pictures of relatively high quality, even higher than the quality of subsequently displayed pictures by the display panels in general including the application of the known method which are DC balanced only after two picture updates.

It is furthermore favorable, if the drive means are arranged for controlling the potential difference of each picture element to be a sequence of preset potential differences between being the inter-picture potential difference and being the subsequent picture potential difference, the sequence of preset potential differences having preset values and associated preset durations, the preset values in the sequence alternating in sign, each preset potential difference representing a preset energy sufficient to release particles present in one of two extreme positions, being positions near the electrodes and members of the number of positions, from their position but insufficient to enable said particles to reach the other one of the extreme positions. As an advantage, due to the sequences of preset potential differences the picture quality increases. Such sequences of preset values are described in the non-prepublished European Patent application 02077017.8 (PHNL020441).

These and other aspects of the display panel of the invention will be further elucidated and described with reference to the drawings, in which.

In all the Figures corresponding parts are referenced to by the same reference numerals.

Figure 1:
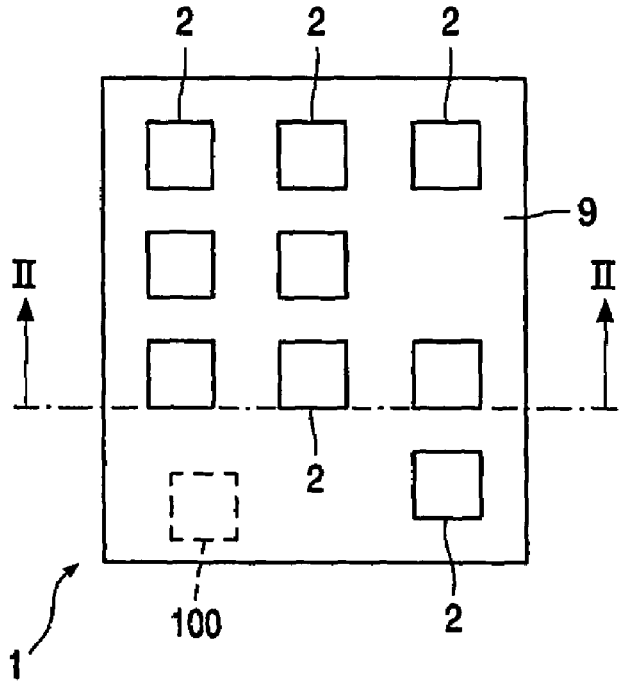
FIG. 1 shows diagrammatically a front view of an embodiment of the display panel.
Figure 2:
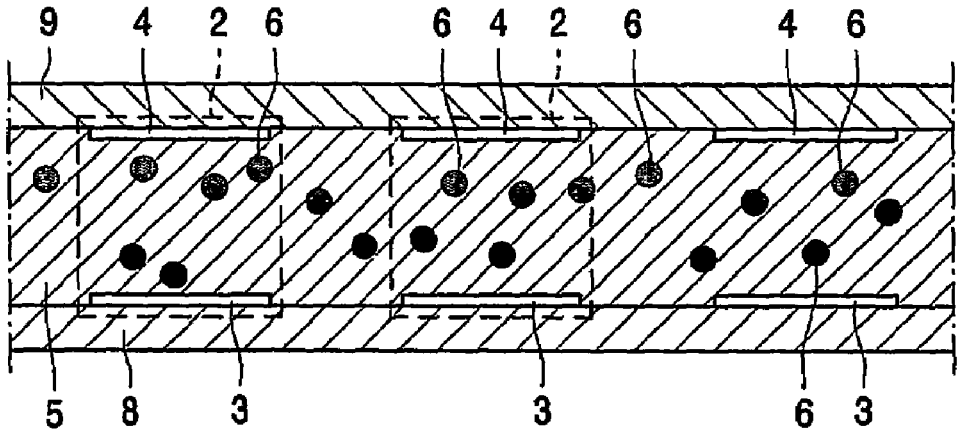
FIG. 2 shows diagrammatically a cross-sectional view along II-II in FIG. 1.
Figure 3:
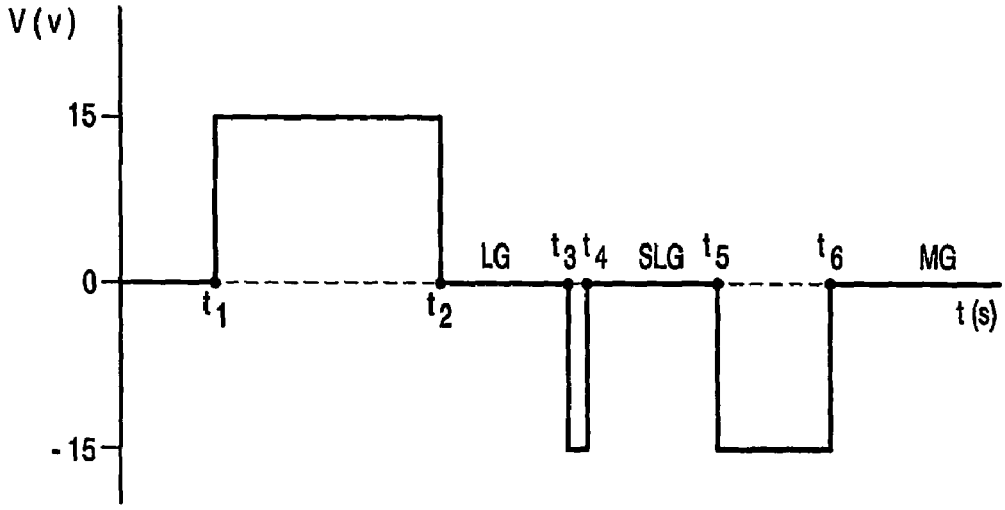
FIG. 3 shows diagrammatically the potential difference as a function of time for a picture element in the embodiment.

FIGS. 1 and 2 show the embodiment of the display panel 1 having a first substrate 8, a second opposed substrate 9 and a plurality of picture elements 2. Preferably, the picture elements 2 are arranged along substantially straight lines in a two-dimensional structure. Other arrangements of the picture elements 2 are alternatively possible, e.g. a honeycomb arrangement. An electrophoretic medium 5, having charged particles 6 in a fluid, is present between the substrates 8,9. A first and a second electrode 3,4 are associated with each picture element 2 for receiving a potential difference. In FIG. 2 the first substrate 8 has for each picture element 2 a first electrode 3, and the second substrate 9 has for each picture element 2 a second electrode 4. The charged particles 6 are able to occupy extreme positions near the electrodes 3,4 and intermediate positions in between the electrodes 3,4. Each picture element 2 has an appearance determined by the position of the charged particles 6 between the electrodes 3,4. Electrophoretic media 5 are known per se from e.g. U.S. Pat. No. 5,961,804, U.S. Pat. No. 6,120,839 and U.S. Pat. No. 6,130,774 and can e.g. be obtained from E Ink Corporation. As an example, the electrophoretic medium 5 comprises negatively charged black particles 6 in a white fluid. When the charged particles 6 are in a first extreme position, i.e. near the first electrode 3, as a result of the potential difference being e.g. 15 Volts, the appearance of the picture element 2 is e.g. white. Here it is considered that the picture element 2 is observed from the side of the second substrate 9. When the charged particles 6 are in a second extreme position, i.e. near the second electrode 4, as a result of the potential difference being of opposite polarity, i.e. −15 Volts, the appearance of the picture element 2 is black. When the charged particles 6 are in one of the intermediate positions, i.e. in between the electrodes 3,4, the picture element 2 has one of the intermediate appearances, e.g. light gray, middle gray and dark gray, which are gray levels between white and black. The drive means 100 are arranged for controlling the potential difference of each picture element 2 to be a picture potential difference having a picture value and an associated picture duration representing a picture energy for enabling the particles 6 to occupy one of the positions for displaying one of the pictures, subsequently to be an inter-picture potential difference having an inter-picture value and an inter-picture duration representing an inter-picture energy and subsequently to be a subsequent picture potential difference for enabling the particles 6 to occupy one of the positions for displaying a subsequent one of the pictures. Furthermore, the drive means 100 are arranged for controlling for each picture element 2 the inter-picture value to have a sign opposite to a sign of the picture value and the inter-picture energy to be insufficient to substantially change the position of the particles 6 and the inter-picture energy to be chosen in a range from larger than zero to substantially equal to the picture energy for reducing an undesired charge accumulation in the picture element. In an example, the potential difference of a picture element 2 is shown as a function of time in FIG. 3. The picture potential difference of the picture element 2 is present from time t1 to time t2 and has e.g. a picture value of 15 Volts and an associated picture duration of 30 ms, and the appearance of the picture element 2 for displaying one of the pictures is light gray, denoted by LG. The inter-picture potential difference is present from time t3 to time t4 and has e.g. a inter-picture value of −15 Volts and an associated inter-picture duration of 5 ms. This is an example of the inter-picture value having a magnitude substantially equal to the magnitude of the picture value. As a result, part of the charging of the insulators due to the picture potential difference is undone, whereas the position of the particles 6 is substantially unchanged, i.e. the appearance of the picture element 2 is substantially light gray, denoted by SLG. The subsequent picture potential difference is present from time t5 to time t6 and has e.g. a subsequent picture value of −15 Volts and an associated subsequent picture duration of 50 ms. As a result the picture element 2 has an appearance being middle gray, denoted by MG, for displaying a subsequent one of the pictures.

Figure 4:
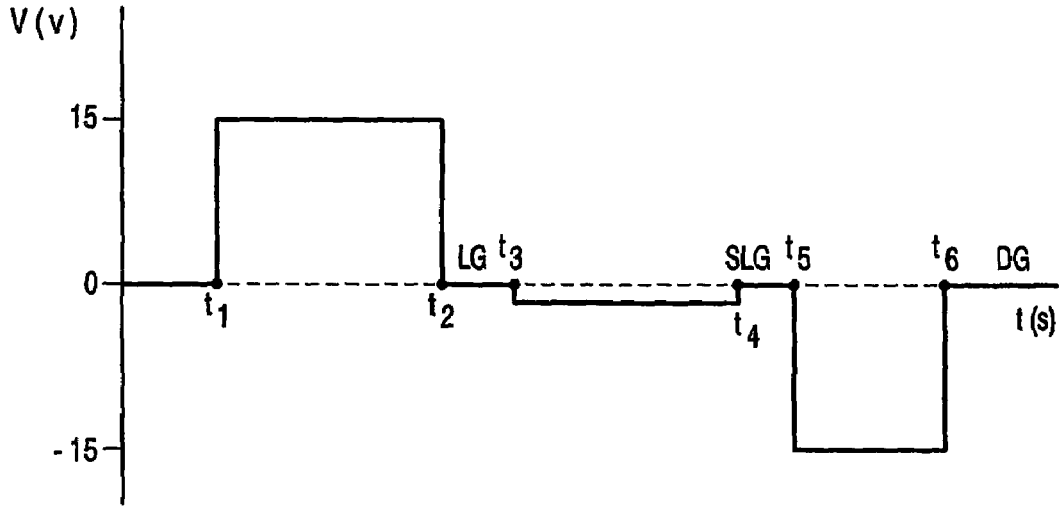
FIG. 4 shows diagrammatically the potential difference as a function of time for another picture element in the embodiment.

In an embodiment the drive means 100 are arranged for controlling for each picture element 2 the inter-picture value to have a magnitude being at least one order of magnitude smaller than a magnitude of the picture value. In an example, the potential difference of another picture element 2 is shown as a function of time in FIG. 4. The picture potential difference of the picture element 2 is present from time t1 to time t2 and has e.g. a value of 15 Volts and a duration of 50 ms, and the appearance of the picture element 2 for displaying one of the pictures is light gray. The inter-picture potential difference is present from time t3 to time t4 and has e.g. an inter-picture value of −4.5 Volts and an associated inter-picture duration of 1000 ms. As a result, a relatively large part, compared to the previous example, of the charging of the insulators due to the picture potential difference is undone, whereas the position of the particles 6 is substantially unchanged, i.e. the appearance of the picture element 2 is substantially light gray. As the inter-picture value of −0.5 Volts is unable to substantially change the position of the particles irrespective of the associated inter-picture duration, the charging of the insulators due to the picture potential difference is undone if the associated inter-picture duration is 1500 ms. The subsequent picture potential difference is present from time t5 to time t6 and has e.g. a subsequent picture value of −15 Volts and an associated subsequent picture duration of 100 ms. As a result the picture element 2 has an appearance being dark gray, denoted by DG, for displaying a subsequent one of the pictures. In a variation on the embodiment the drive means 100 are arranged for controlling for each picture element 2 the inter-picture value to have a magnitude being two orders of magnitude smaller than the magnitude of the picture value. As an example, consider the inter-picture potential difference of FIG. 4, present from time t3 to time t4, to have e.g. an inter-picture value of −0.12 Volts and an associated inter-picture duration of 1600 ms.

Figure 5:
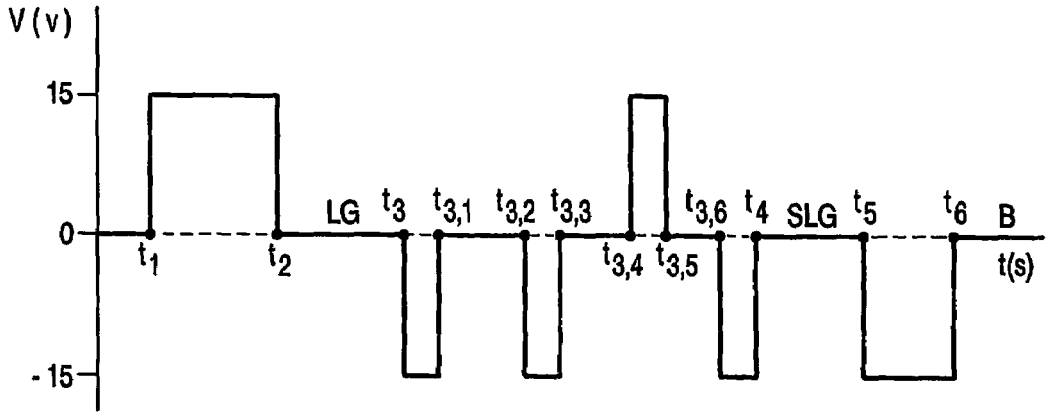
FIG. 5 shows diagrammatically the potential difference as a function of time for a picture element in another embodiment.
Figure 6:
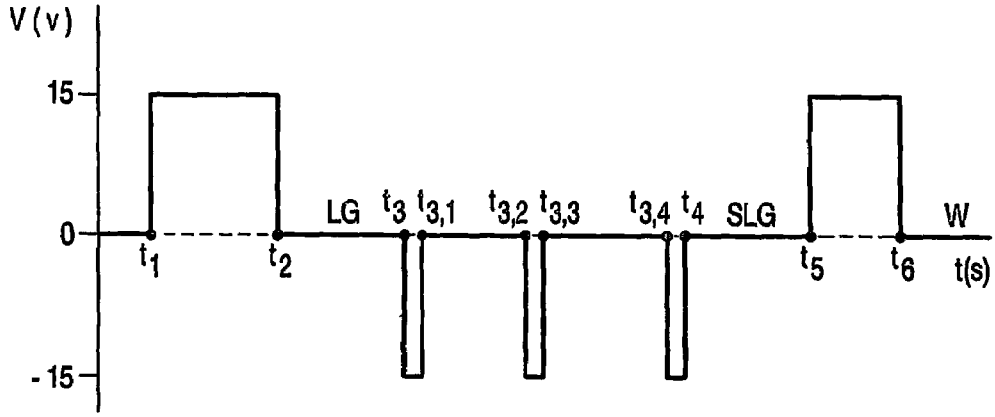
FIG. 6 shows diagrammatically the potential difference as a function of time for another picture element in a variation of the embodiment.

In another embodiment, the drive means 100 are arranged for controlling for each picture element 2 the inter-picture potential difference to have a predetermined number of sub-inter-picture potential differences, each sub-inter-picture potential difference having a sub-inter-picture value and an associated sub-inter-picture duration representing a sub-inter-picture energy. Furthermore, a time average of the inter-picture values has a sign opposite to the sign of the picture value, and each sub-inter-picture energy is insufficient to substantially change the position of the particles 6. In an example, the potential difference of a picture element 2 is shown as a function of time in FIG. 5. The picture potential difference of the picture element 2 is present from time t1 to time t2 and has e.g. a picture value of 15 Volts and an associated picture duration of 20 ms, and the appearance of the picture element 2 for displaying one of the pictures is light gray. The inter-picture potential difference is present from time t3 to time t4 and has e.g. four sub-inter-picture potential differences, subsequently present from time t3 to time t3,1, from time t3,2 to time t3,3, from time t3,4 to time t3,5 and from time t3,6 to time t4. The four sub-inter-picture potential differences subsequently have e.g. sub-inter-picture values of −15 Volts, −15 Volts, 15 Volts and −15 Volts and associated sub-inter-picture durations of 5 ms. The time average of the sub-inter-picture values is −7.5 Volts, being (−15*5*3+15*5)/(4*5). As a result, part of the charging of the insulators due to the picture potential difference is undone, whereas the position of the particles 6 is substantially unchanged, i.e. the appearance of the picture element 2 is substantially light gray. The subsequent picture potential difference is present from time t5 to time t6 and has e.g. a subsequent picture value of −15 Volts and an associated subsequent picture duration of 150 ms. As a result the picture element 2 has an appearance being black, denoted by B, for displaying a subsequent one of the pictures. In a variation, the drive means 100 are furthermore arranged for controlling for each picture element 2 each inter-picture value to have a sign opposite to the sign of the picture value. In an example, the potential difference of a picture element 2 is shown as a function of time in FIG. 6. The picture potential difference of the picture element 2 is present from time t1 to time t2 and has e.g. a picture value of 15 Volts and an associated picture duration of 12 ms, and the appearance of the picture element 2 for displaying one of the pictures is light gray. The inter-picture potential difference is present from time t3 to time t4 and has e.g. three sub-inter-picture potential differences, subsequently present from time t3 to time t3,1, from time t3,2 to time t3,3 and from time t3,4 to time t4. Each sub-inter-picture value has a sign opposite to the sign of the picture value, e.g. the sub-inter-picture values are −15 Volts and the associated sub-inter-picture durations are 4 ms. As the inter-picture energy is equal to the picture energy, the charging of the insulators due to the picture potential difference is undone, whereas the position of the particles 6 is substantially unchanged, i.e. the appearance of the picture element 2 is substantially light gray. The subsequent picture potential difference is present from time t5 to time t6 and has e.g. a subsequent picture value of 15 Volts and an associated subsequent picture duration of 50 ms. As a result the picture element 2 has an appearance being white, denoted by W, for displaying a subsequent one of the pictures.

Figure 7:
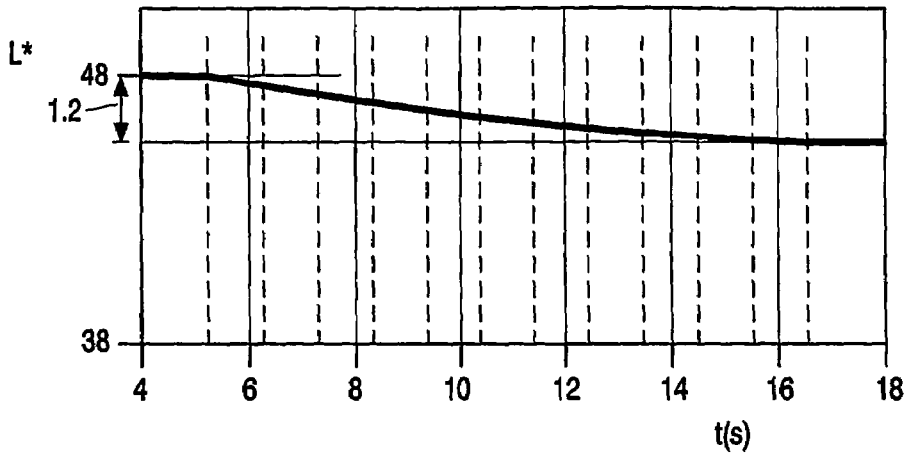
FIG. 7 shows experimental results of the appearance of a picture element expressed in brightness L* as a function of time for a picture element in an embodiment.

FIG. 7 shows experimental results of the appearance of a picture element 2 expressed in brightness L* as a function of time for a picture element in an embodiment. The optical response is shown due to 12 sub-inter-picture potential differences, denoted by dashed lines. Each sub-inter-picture value is 15 Volts, having a sign opposite to the sign of the picture value, and the associated sub-inter-picture durations are 5 ms. The time interval between subsequent sub-inter-picture potential differences is one second. As a result of the sub-inter-picture potential differences the appearance of the picture element 2 has changed only by a relatively small amount, being about 1.2 L*.

Figure 8:
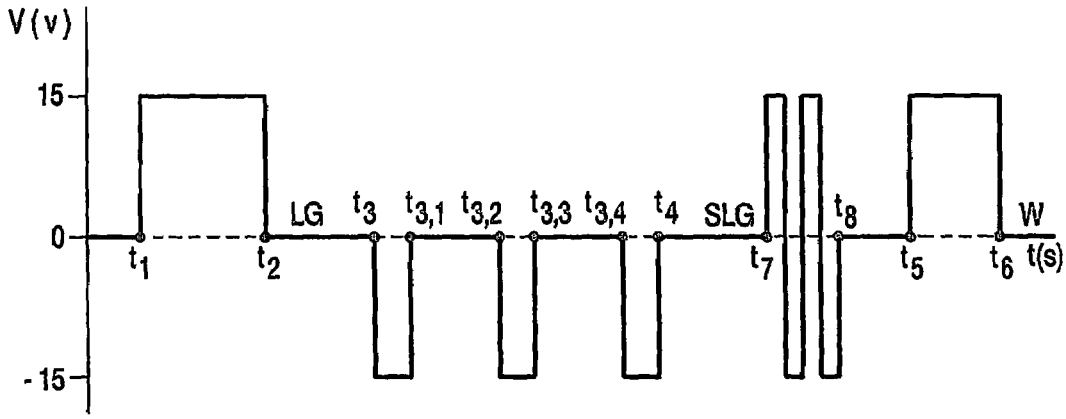
FIG. 8 shows diagrammatically the potential difference as a function of time for another picture element in a variation of the embodiment.

In another embodiment the drive means 100 are arranged for controlling the potential difference of each picture element 2 to be a sequence of preset potential differences between being the inter-picture potential difference and being the subsequent picture potential difference, the sequence of preset potential differences having preset values and associated preset durations, the preset values in the sequence alternating in sign, each preset potential difference representing a preset energy sufficient to release particles 6 present in one of two extreme positions, being positions near the electrodes 3,4 and members of the number of positions, from their position but insufficient to enable said particles 6 to reach the other one of the extreme positions. In an example, the potential difference of a picture element 2 is shown as a function of time in FIG. 8. The picture potential difference of the picture element 2 is present from time t1 to time t2 and has e.g. a picture value of 15 Volts and an associated picture duration of 12 ms, and the appearance of the picture element 2 for displaying one of the pictures is light gray. The inter-picture potential difference is present from time t3 to time t4 and has e.g. three sub-inter-picture potential differences, subsequently present from time t3 to time t3,1, from time t3,2 to time t3,3 and from time t3,4 to time t4. The sub-inter-picture values are −15 Volts and the associated sub-inter-picture durations are 4 ms. As the inter-picture energy is equal to the picture energy, the charging of the insulators due to the picture potential difference is undone, whereas the position of the particles 6 is substantially unchanged, i.e. the appearance of the picture element 2 is substantially light gray. In the example, the sequence of preset potential differences has 4 preset values, subsequently 15 Volts, −15 Volts, 15 Volts and −15 Volts, applied from time t7 to time t8. Each preset value is applied for e.g. 20 ms. The time interval between t8 and t5 is negligibly small. The subsequent picture potential difference is present from time t5 to time t6 and has e.g. a subsequent picture value of 15 Volts and an associated subsequent picture duration of 50 ms. As a result the picture element 2 has an appearance being white for displaying a subsequent one of the pictures.

The invention claimed is:

1. An electrophoretic display panel for displaying pictures, comprising:

an electrophoretic medium comprising charged particles in a fluid;

a plurality of picture elements ;

a first and a second electrode associated with each picture element for receiving a potential difference; and drive means, the charged particles being able to occupy a position being one of a number of positions between the electrodes, and the drive means being arranged for controlling the potential difference of each picture element to be a picture potential difference having a picture value and an associated picture duration representing a picture energy for enabling the particles to occupy one of the positions for displaying one of the pictures, subsequently to be an inter-picture potential difference having an inter-picture value and an associated inter-picture duration representing an inter-picture energy and subsequently to be a subsequent picture potential difference for enabling the particles to occupy one of the positions for displaying a subsequent one of the pictures, characterized in that the drive means are arranged for controlling for each picture element the inter-picture value to have a sign opposite to a sign of the picture value and the inter-picture energy to be insufficient to substantially change the position of the particles and chosen in a range from larger than zero to substantially equal to the picture energy for reducing an undesired charge accumulation in the picture element.

2. A display panel as claimed in claimed 1 characterized in that the drive means are arranged for controlling for each picture element the inter-picture value to have a magnitude substantially equal to a magnitude of the picture value.

3. A display panel as claimed in claimed 1 characterized in that the drive means are arranged for controlling for each picture element the inter-picture value to have a magnitude being at least one order of magnitude smaller than a magnitude of the picture value.

4. A display panel as claimed in claimed 3 characterized in that the drive means are arranged for controlling for each picture element the inter-picture value to have a magnitude being two orders of magnitude smaller than the magnitude of the picture value.

5. A display panel as claimed in claimed 1 characterized in that the drive means are arranged for controlling for each picture element the inter-picture potential difference to have a predetermined number of sub-inter-picture potential differences, each sub-inter-picture potential difference having a sub-inter-picture value and an associated sub-inter-picture duration representing a sub-inter-picture energy, a time average of the inter-picture values having a sign opposite to the sign of the picture value, and each sub-inter-picture energy being insufficient to substantially change the position of the particles.

6. A display panel as claimed in claimed 5 characterized in that the drive means are arranged for controlling for each picture element each inter-picture value to have a sign opposite to the sign of the picture value.

7. A display panel as claimed in claimed 6 characterized in that the inter-picture energy is substantially equal to the picture energy.

8. A display panel as claimed in claim 1 characterized in that the drive means are arranged for controlling the potential difference of each picture element to be a sequence of preset potential differences between being the inter-picture potential difference and being the subsequent picture potential difference, the sequence of preset potential differences having preset values and associated preset durations, the preset values in the sequence alternating in sign, each preset potential difference representing a preset energy sufficient to release particles present in one of two extreme positions, being positions near the electrodes and members of the number of positions, from their position but insufficient to enable said particles to reach the other one of the extreme positions.

* * * * *